US005624040A

United States Patent [19]

Hono

[11] Patent Number: 5,624,040

[45] Date of Patent: Apr. 29, 1997

[54] THEFT-PREVENTIVE DISPLAY HOOK SYSTEM

[76] Inventor: Eiji Hono, 4-13-2 Seijo, Setagaya-ku, Tokyo, Japan

[21] Appl. No.: 391,720

[22] Filed: Feb. 21, 1995

[51] Int. Cl.[6] ..... E05B 73/00

[52] U.S. Cl. ..... 211/4; 211/7; 211/59.1

[58] Field of Search ..... 211/4, 6, 7, 57.1, 211/181, 59.1; 248/551, 214; 40/655, 657, 659, 617; 411/405, 919; 70/14, 46, 61, 62, 199

[56] References Cited

U.S. PATENT DOCUMENTS

| | | | |
|---|---|---|---|
| 153,673 | 8/1874 | Fox | 70/62 X |
| D. 200,617 | 3/1965 | Smith | 211/59.1 X |
| 738,911 | 9/1903 | Johns | 40/657 |
| 873,446 | 12/1907 | Manheim | 211/87 X |
| 1,022,980 | 4/1912 | Stringer | 211/7 |
| 1,488,390 | 3/1924 | Glenny | 40/657 |
| 1,789,628 | 1/1931 | Hobbs | 40/657 X |
| 2,182,488 | 12/1939 | Cowen | 211/59.1 |
| 2,451,747 | 10/1948 | Kindt | 411/405 X |
| 3,174,383 | 3/1965 | Heil | 411/405 |
| 3,622,011 | 11/1971 | Snow | 248/551 X |
| 4,289,242 | 9/1981 | Kenyon | 211/4 |
| 4,407,418 | 10/1983 | Brammer | 211/87 |
| 4,462,497 | 7/1984 | Maule | 211/59.1 X |
| 5,027,622 | 7/1991 | Hatch et al. | 211/7 X |
| 5,259,220 | 11/1993 | Fredrickson | 211/7 X |
| 5,275,027 | 1/1994 | Eklof et al. | 211/4 X |
| 5,465,851 | 11/1995 | Smith | 211/59.1 |

FOREIGN PATENT DOCUMENTS

| | | | |
|---|---|---|---|
| 137160 | of 1920 | United Kingdom | 411/405 |

*Primary Examiner*—Ramon O. Ramirez
*Assistant Examiner*—Sandra S. Snapp
*Attorney, Agent, or Firm*—Juettner Pyle Lloyd & Piontek

[57] ABSTRACT

A security system for a display rack is provided in which merchandise in packages is threaded through an opening in the packaging over the free end of a hanger rod for display. The free end of the hanger rod is threaded, and a threaded cap is treated onto the free end of the rod to prevent removal of the package. The cap has a pair of opposed grooves, and a special key 13 is provided to remove the cap.

9 Claims, 5 Drawing Sheets

THEFT-PREVENTIVE DISPLAY HOOK SYSTEM

BACKGROUND OF THE INVENTION

This invention relates to the theft-preventive display hooks used for hanging packages which contain merchandise for sale in stores or the like.

Many types of merchandise are packed and sold in containers hanging on display hooks at stores such as supermarkets, department stores and others. This type of display hook is provided with a plurality of rods, bars or hooks capable of hanging packing containers by inserting the bars through holes punched in the merchandise container. The containers, therefore, can easily be removed from the hanging bars by simply pulling the container off the end of the bar. Thus, conventional display hooks have a shortcoming in that shoplifting is easily conducted.

SUMMARY OF THE INVENTION

The present invention provides an antitheft or security system for a display rack in which merchandise or containers for merchandise is hung on outwardly extending supports or rods having free ends. The free end of each rod is threaded, and an enlarged threaded cap is removably secured onto the free end. The cap has a diameter larger than the mounting hole in the merchandise container to prevent unauthorized removal of theft of the container.

The retaining cap is provided a pair of opposed grooves, and a special key having spaced ears is provided and employed to tightly install and later remove the end cap. The system deters unauthorized removal of merchandise and also provides a visual deterrent.

DESCRIPTION OF THE PREFERRED EMBODIMENTS

Figure 1:
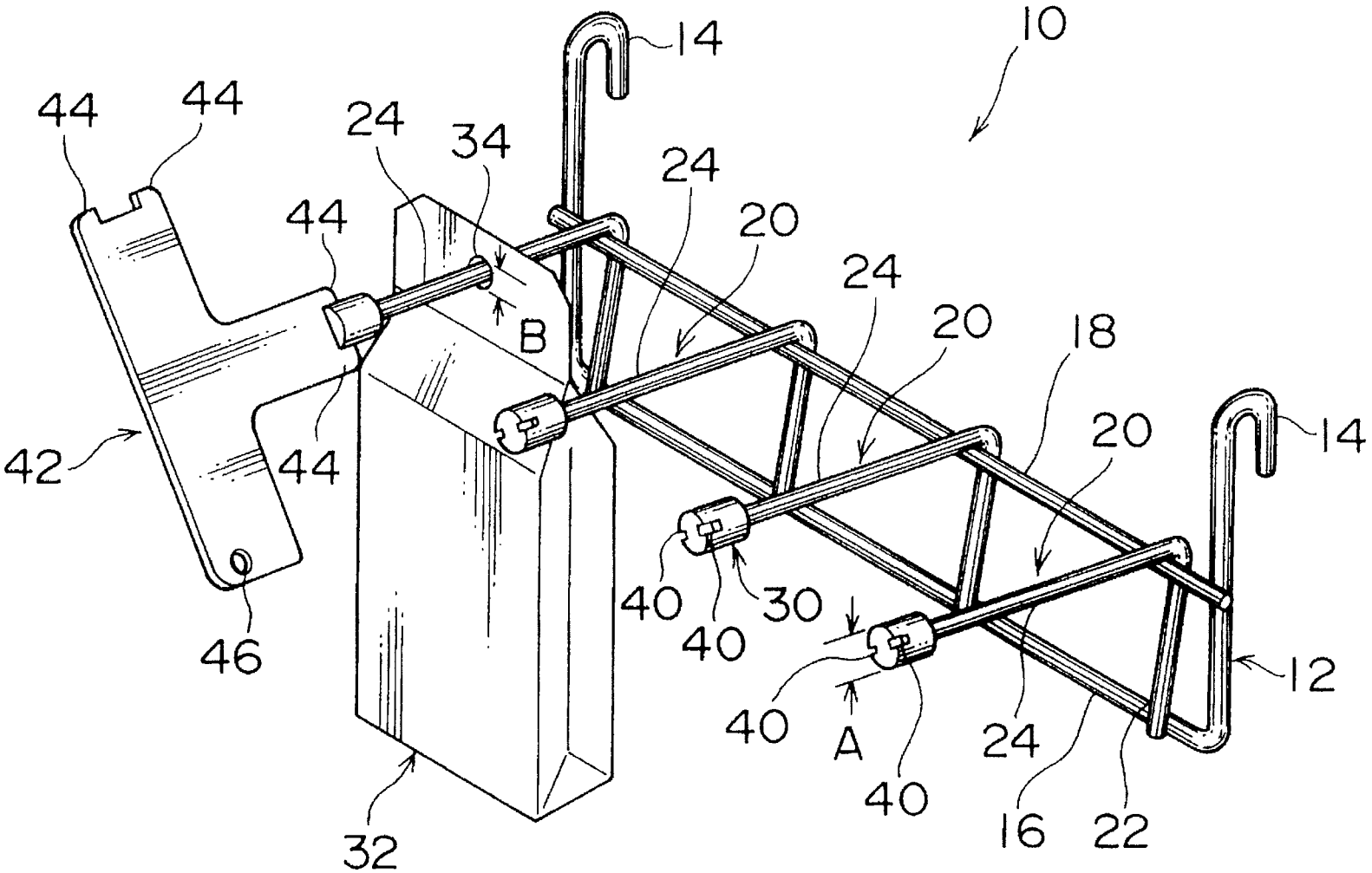
FIG. 1 is a perspective view of the antitheft display hook system of the present invention.

As shown in FIG. 1, the theft deterrent system of the present invention is especially suitable for use with merchandise containers 32 having an upper portion provided with a mounting hole 34 of diameter B, whereby the container is adapted to be hung or suspended on a hook or rod.

Figure 2:
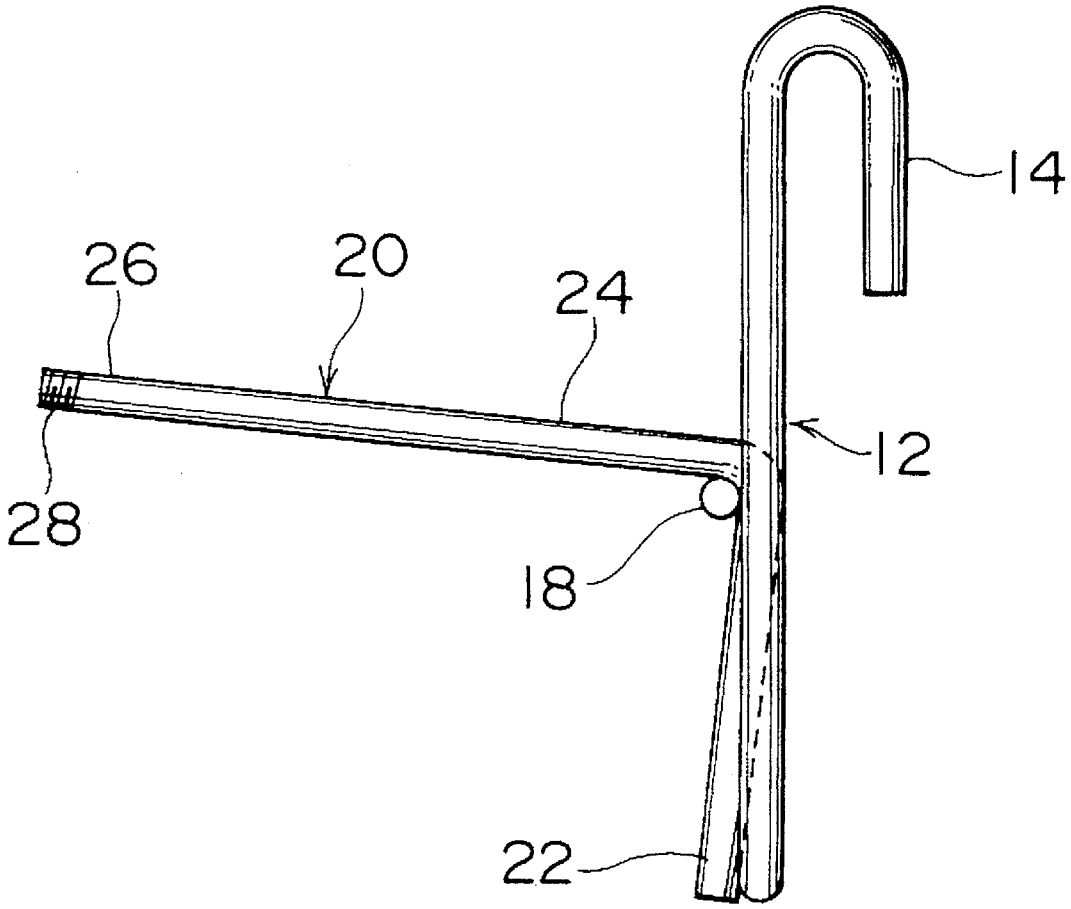
FIG. 2 is a side view of the structural components of the display hook shown in FIG. 1.

As shown in FIGS. 1 and 2 the display device 10 comprises one or a plurality of fixed hangers member 20 together with means to support the free ends of the hangers in an outwardly facing direction, or generally horizontally.

In the preferred embodiment, the hanger assembly is in the form of a bracket comprising a U-shaped member 12 having an elongate horizontal portion 16 and spaced upwardly extending vertical hooked legs 14 to enable hanging of the bracket or a vertical support. A second horizontal member 18 is secured near its ends between the legs 14 and is in spaced relationship from member 16 to provide a rectangular support.

The hanger member 20 are generally L-shaped and comprise a vertical base leg 22, outwardly overlapping and secured near its free end to bracket member 16 and bent around and secured to member 18, with the rod extending horizontally outwardly in the form of a hanging hook or rod 24 having a free end 26 provided with a male screw 28 formed on said end. Preferably, the hanging rods 24 are inclined slightly upwardly to cause containers 32 to slide toward the rear bracket by gravity. As shown, the structure is made of metal wire or bar and may be secured together by welding.

Figure 6:
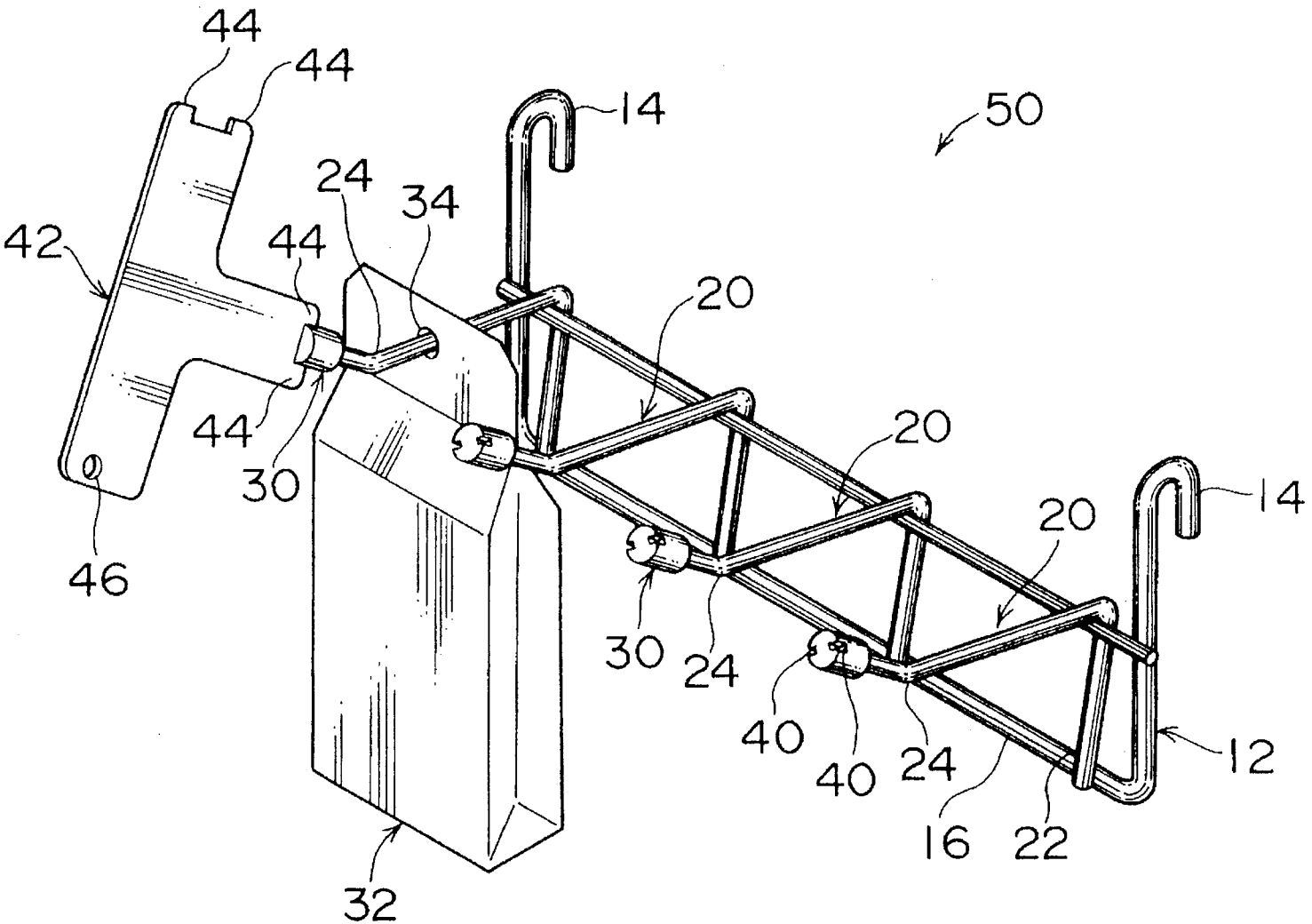
FIG. 6 is a perspective view of a second embodiment of the antitheft display hook system of the present invention.

FIG. 6 shows a device 50 identical to the device 10 of FIG. 1, except that the hanging rods 24 extend horizontally outwardly from the support bracket and are bent upwardly at a rounded comer near their ends 26 in order to prevent the merchandise containers 32 from falling out of the display.

Figure 3:
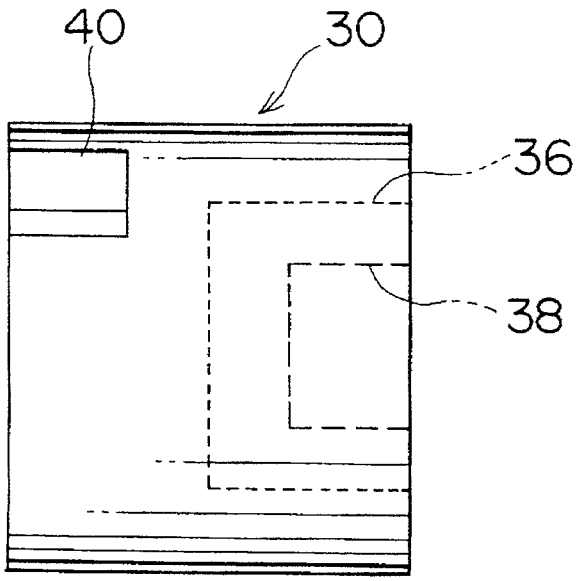
FIG. 3 is a side view of the retaining cap shown in FIG. 1.
Figure 4:
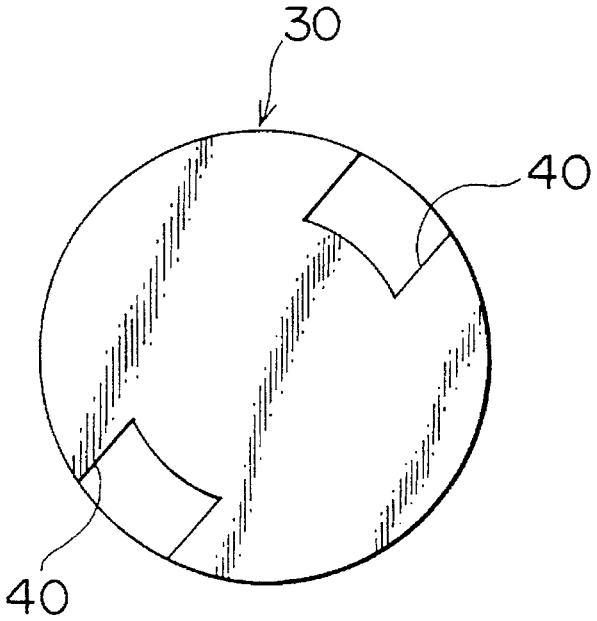
FIG. 4 is a plan view of the cap shown in FIG. 3.

As shown in FIGS. 1, 3 and 4, an enlarged knob or cap 30 is provided for removable threaded securement to the end 26 of the hanging rods 24. The cap is preferably in the form of a cylindrical section having an outer slippery or smooth surface. For example, the body of the cap 30 may be composed of plastic and may have an opening 36 in one end receiving a threaded metal nut 38. In the alternative, the cap 30 may be composed of a single material. The diameter A of the cap is selected to be greater than the diameter of the mounting hole B in the container 32.

The outwardly facing end of the cap 30 is provided with a pair of opposed box grooves or keyways 40. As shown, the grooves may extend inwardly from the outer cylindrical perimeter of the cap, but other configurations can easily be envisioned.

Figure 5:
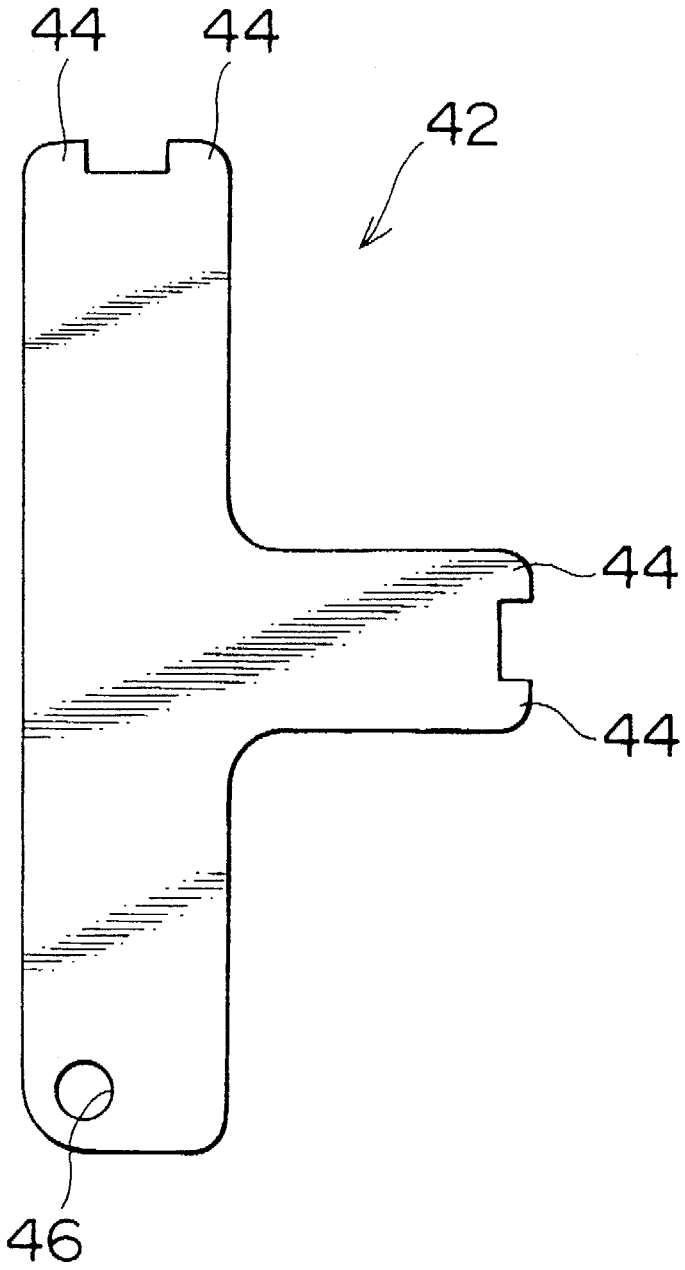
FIG. 5 is a plan view of the cap removal key shown in FIG. 1.

As shown in FIG. 1 and 5, a key 42 is provided for engaging and turning the cap 30. As shown, the key is preferably in the form of a T-shaped handle with three legs, with at least one of the legs having spaced lugs or ears 44 which match or fit the opposed recesses 40 in the cap, so as to drivingly engage the cap. The T-shaped key provides better leverage and creates the possibility of providing a second set of ears on a second leg and a hanging opening 46 in the third leg.

In use, the merchandise containers 32 are installed on the hanging rods 24 in the usual fashion, and the retaining caps 30 are then threaded on and tightened beyond finger tight with the use of the key 42. The consumer cannot easily remove the package without damage or tearing of the container, and unauthorized removal is discouraged. Obviously, various different and unique keying systems can be employed to increase overall security.

I claim:

1. A theft preventive display hook system to prevent unauthorized removal of a merchandise container having a mounting hole of a first diameter, said system comprising a hanging member further comprising a hanging rod for said container, means for rigidly and fixedly supporting said hanging rod in an outwardly extending direction, a threaded free end on said hanging rod about which said merchandise containers are placed and suspended from said rod, a cap threadedly engageable with said threaded free end, said cap having an outer diameter greater than said first diameter, a slippery or smooth exterior surface substantially preventing hand rotation of said cap and opposed, outwardly open grooves in said cap, and key means for rotating said cap into and out of threaded engagement with said hanging rod, said key means having portions drivingly engageable with the open grooves in said cap.

2. The system of claim 1 wherein said cap has a pair of opposed spaced grooves in the outwardly facing end thereof, and said key means comprises a handle having a pair of opposed spaced lugs matching said grooves.

3. The system of claim 1 in which said hanging rod is inclined upwardly from horizontal.

4. The system of claim 1 wherein said cap has a cylindrical shape.

5. The system of claim 1 wherein said cap comprises a plastic body and a threaded insert.

6. The system of claim 1 wherein the means for supporting said hanging member comprises a bracket secured to said rod.

7. The system of claim 6 additionally comprising means for mounting said bracket on a support.

8. The system of claim 6 wherein said hanging member comprises a vertical portion secured to said bracket.

9. The system of claim 2 wherein said handle has three legs, with one of said legs bearing said lugs.

* * * * *